US010260216B2

(12) United States Patent
Zhu et al.

(10) Patent No.: US 10,260,216 B2
(45) Date of Patent: Apr. 16, 2019

(54) PULL-OUT FAUCET WITH MAGNETIC DOCKING SYSTEM

(71) Applicant: Xiamen Lota International Co., Ltd., Xiamen (CN)

(72) Inventors: Chuanbao Zhu, Xiamen (CN); Liming Ye, Xiamen (CN); Jianping Zhou, Xiamen (CN); Bentai Chen, Xiamen (CN)

(73) Assignee: XIAMEN LOTA INTERNATIONAL CO., LTD., Fujian (CN)

( * ) Notice: Subject to any disclaimer, the term of this patent is extended or adjusted under 35 U.S.C. 154(b) by 0 days.

(21) Appl. No.: 15/688,494

(22) Filed: Aug. 28, 2017

(65) Prior Publication Data

US 2019/0040611 A1 Feb. 7, 2019

Related U.S. Application Data

(60) Provisional application No. 62/539,851, filed on Aug. 1, 2017.

(51) Int. Cl.
*E03C 1/04* (2006.01)
*B05B 15/65* (2018.01)

(52) U.S. Cl.
CPC ..... *E03C 1/0404* (2013.01); *B05B 15/65* (2018.02); *E03C 2001/0415* (2013.01)

(58) Field of Classification Search
CPC ..... E03C 1/02
USPC ..... 4/675
See application file for complete search history.

(56) References Cited

U.S. PATENT DOCUMENTS

| | | | |
|---|---|---|---|
| 5,771,934 | A | 6/1998 | Warshawsky |
| 5,960,832 | A | 10/1999 | Warshawsky |
| 6,250,338 | B1 | 6/2001 | Dempsey |
| 6,460,570 | B1 | 10/2002 | Jones et al. |
| 6,915,817 | B2 | 7/2005 | Benstead et al. |
| 7,909,061 | B2 | 3/2011 | Nelson |
| 8,387,661 | B2 | 3/2013 | Nelson |
| 8,413,686 | B2 | 4/2013 | Ko |
| 8,496,028 | B2 | 7/2013 | Nelson et al. |
| 8,578,562 | B2 | 11/2013 | Liu et al. |
| 8,713,725 | B2 | 5/2014 | Alder et al. |
| 8,875,738 | B2 | 11/2014 | Yang et al. |
| 9,145,664 | B2 | 9/2015 | Yuan et al. |

(Continued)

FOREIGN PATENT DOCUMENTS

| | | |
|---|---|---|
| CN | 204901055 U | 12/2015 |
| DE | 9111306 U1 | 2/1993 |

(Continued)

OTHER PUBLICATIONS

Search Report and Opinion issued in App. No. EP17210354.1 (dated Aug. 7, 2018).

*Primary Examiner* — Lori Baker
(74) *Attorney, Agent, or Firm* — Barnes & Thornburg LLP

(57) ABSTRACT

A pull-down faucet includes a spout and a water hose movable within the spout. A spray hose connector is attached to the discharge end of the water hose. A sprayhead is in fluid communication with the spray hose connector and the water hose, and is movable between a docked position adjacent the discharge end of the spout, to an undocked position away from the spout. A magnet is secured to the interior of the spray hose connector, and a metallic element is secured near the discharge end of the spout.

19 Claims, 12 Drawing Sheets

(56) References Cited

U.S. PATENT DOCUMENTS

| | | | | |
|---|---|---|---|---|
| 9,181,685 | B2 | 11/2015 | Esche et al. | |
| 9,234,335 | B2 | 1/2016 | Thomas et al. | |
| 9,234,336 | B2 | 1/2016 | Yang | |
| 9,284,723 | B2 | 3/2016 | Esche et al. | |
| 9,315,975 | B2 * | 4/2016 | Davidson | E03C 1/04 |
| 9,334,632 | B2 | 5/2016 | Yang et al. | |
| 9,404,242 | B2 | 8/2016 | Nelson et al. | |
| 9,506,229 | B2 | 11/2016 | Esche et al. | |
| 9,683,353 | B2 * | 6/2017 | Myers | E03C 1/0404 |
| 2006/0283511 | A1 * | 12/2006 | Nelson | E03C 1/0404 137/801 |
| 2008/0185060 | A1 * | 8/2008 | Nelson | E03C 1/0404 137/801 |
| 2010/0043135 | A1 | 2/2010 | Patterson et al. | |
| 2010/0170587 | A1 | 7/2010 | Kaess | |
| 2011/0162743 | A1 | 7/2011 | Nelson | |
| 2013/0320116 | A1 * | 12/2013 | Jonte | B05B 1/18 239/600 |
| 2014/0069520 | A1 * | 3/2014 | Esche | E03C 1/0404 137/315.01 |
| 2014/0166124 | A1 * | 6/2014 | Davidson | E03C 1/0404 137/315.01 |
| 2015/0013812 | A1 | 1/2015 | Bosio | |
| 2015/0014986 | A1 | 1/2015 | Chen et al. | |
| 2015/0113726 | A1 | 4/2015 | Yang et al. | |
| 2015/0267384 | A1 | 9/2015 | Yang et al. | |
| 2015/0368887 | A1 | 12/2015 | Esche et al. | |
| 2016/0090719 | A1 | 3/2016 | Nelson et al. | |
| 2016/0160482 | A1 | 6/2016 | Esche et al. | |
| 2016/0215482 | A1 * | 7/2016 | Fourman | E03C 1/0404 |
| 2016/0237663 | A1 | 8/2016 | Myers et al. | |
| 2016/0258143 | A1 | 9/2016 | Bosio | |
| 2016/0319524 | A1 | 11/2016 | Nelson et al. | |
| 2017/0073944 | A1 | 3/2017 | Esche et al. | |

FOREIGN PATENT DOCUMENTS

| | | |
|---|---|---|
| EP | 1 896 666 A2 | 3/2008 |
| EP | 2 824 246 Al | 1/2015 |
| EP | 3 064 659 Al | 9/2016 |
| EP | 2 690 228 B1 | 11/2016 |
| EP | 3 228 763 Al | 10/2017 |

* cited by examiner

PULL-OUT FAUCET WITH MAGNETIC DOCKING SYSTEM

CROSS-REFERENCE TO RELATED APPLICATIONS

This application claims priority under 35 U.S.C. § 119 to Provisional Application No. 62/539,851 entitled "PULL-OUT FAUCET WITH MAGNETIC DOCKING SYSTEM" filed Aug. 1, 2017 ("the Provisional Application"). The Provisional Application is assigned to the assignee of the present application, and is hereby expressly incorporated by reference.

TECHNICAL FIELD

The invention is directed to a pull-out faucet with a magnetic docking system.

BACKGROUND

This invention relates to a pull-out faucet with a magnetic docking system. More specifically, the invention relates to a novel structure for releasably coupling a pull-out sprayhead to a faucet body.

Kitchen faucets and other faucets with pull-out sprayheads are known in the art. These pull-out sprayheads offer the user significant flexibility. Particularly, when the user pulls the sprayhead away from the faucet and into an "undocked" position, the user may direct water from the undocked sprayhead to a particular part of a sink, or even direct water from the sprayhead to regions remote from the sink, such as to a countertop.

Some current faucets with pull-out sprayheads have certain deficiencies. As but one example, after a certain period of time, the docking systems of these faucets provide inadequate force to move the sprayheads from their undocked positions to a fully docked position. A sprayhead/faucet combination that is not fully docked is not aesthetically appealing to either homeowners or their guests.

The known prior art pull-out faucets rely upon various means to retain the sprayhead within the spout, or to return a sprayhead to its docked position. These can include counterweights, magnets, compression springs, and others.

There is a need for an improved docking system that does not have the limitations or disadvantages of the prior docking systems.

SUMMARY OF THE INVENTION

One embodiment of the invention comprises a faucet; a spout that is a part of that faucet; a water hose with an inlet end and a discharge end, the water hose being disposed within, and movable within, that spout; a spray hose connector attached to the discharge end of the water hose; and a sprayhead that is in fluid communication with the water hose and the spray hose connector, and releasably attached to the water discharge end of the faucet.

The sprayhead is movable from a docked position, where it is secured to the discharge end of the spout; to an undocked position, where it is moved away from that same discharge end of the spout.

Secured to the interior of the spray hose connector is a magnet. This magnet may be of any shape, but is preferably of a hollow, frusto-conical shape, so that it essentially circumscribes the interior of the spray hose connector and permits for the passage of water through the magnet.

The magnet may be held in place within the spray hose connector by any suitable means.

As noted above, when the sprayhead is in its docked position, it is positioned adjacent the discharge end of the spout of the faucet. Also positioned near the discharge end of the spout of the faucet is a metallic element.

This metallic element may preferably have a ring shape. The metallic element can be made of any material that is magnetically attractive. In one preferred embodiment, the metallic element is made of stainless steel, such as SUS 430 stainless steel.

The metallic element is preferably fixed to the inside of the spout by welding.

DETAILED DESCRIPTION

Figure 1:
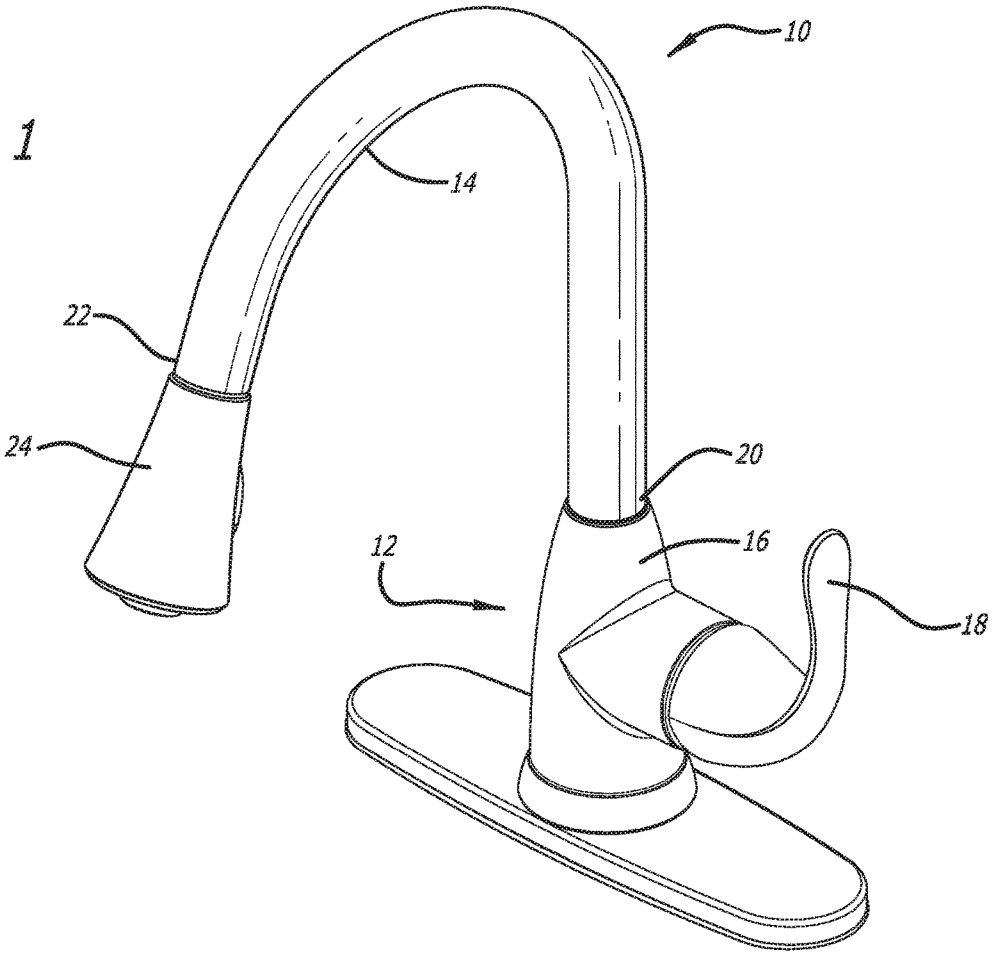
FIG. 1 is a perspective view of a pull-out faucet in accordance with the invention, with the sprayhead in its docked position, and including only the portions of the faucet normally mounted above the deck of a kitchen or bathroom counter.
Figure 2:
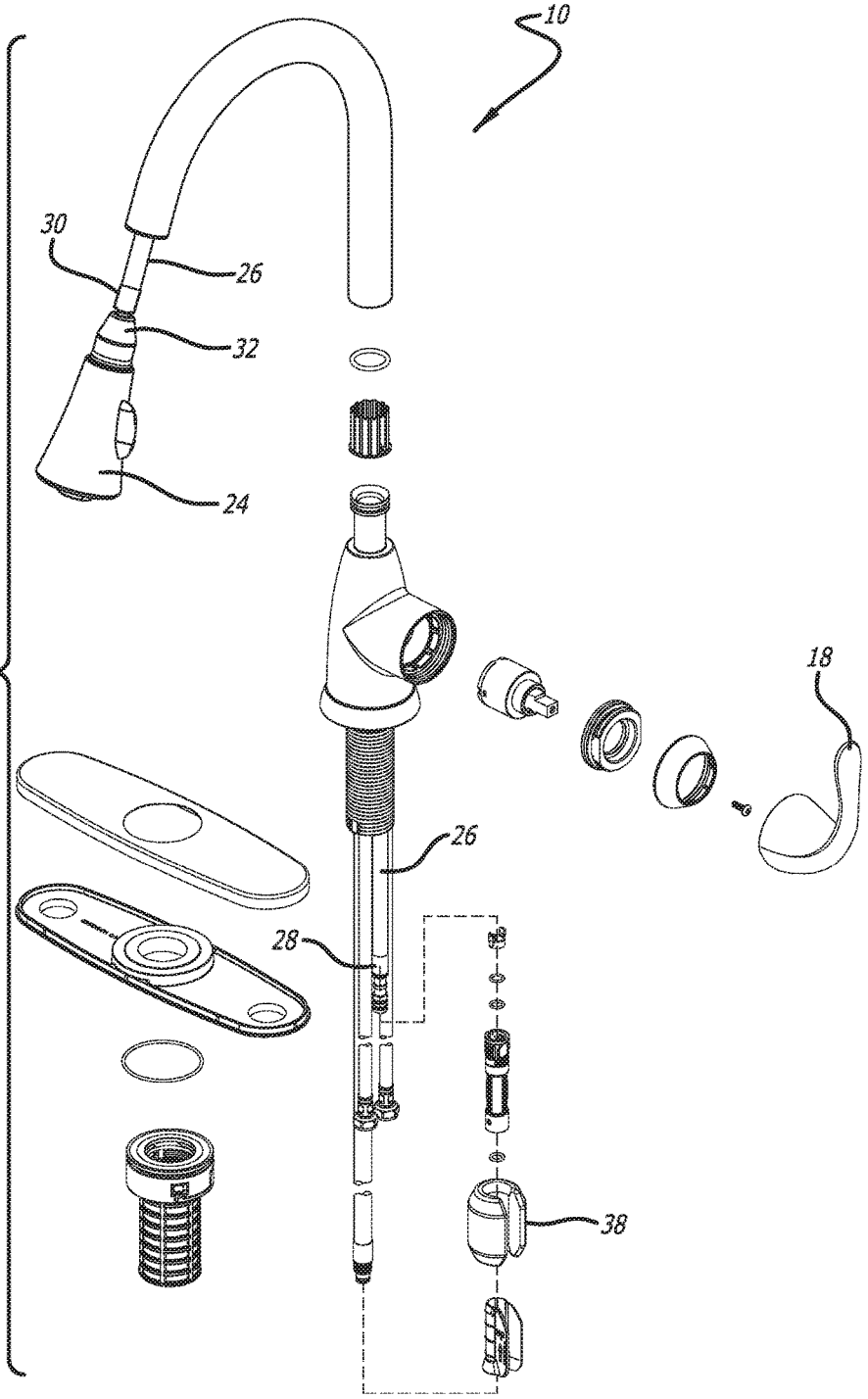
FIG. 2 is an exploded view of the pull-out faucet of FIG. 1, but with the sprayhead in its undocked position, and further including the components of the pull-out faucet that are normally mounted below the deck of the counter.
Figure 3:
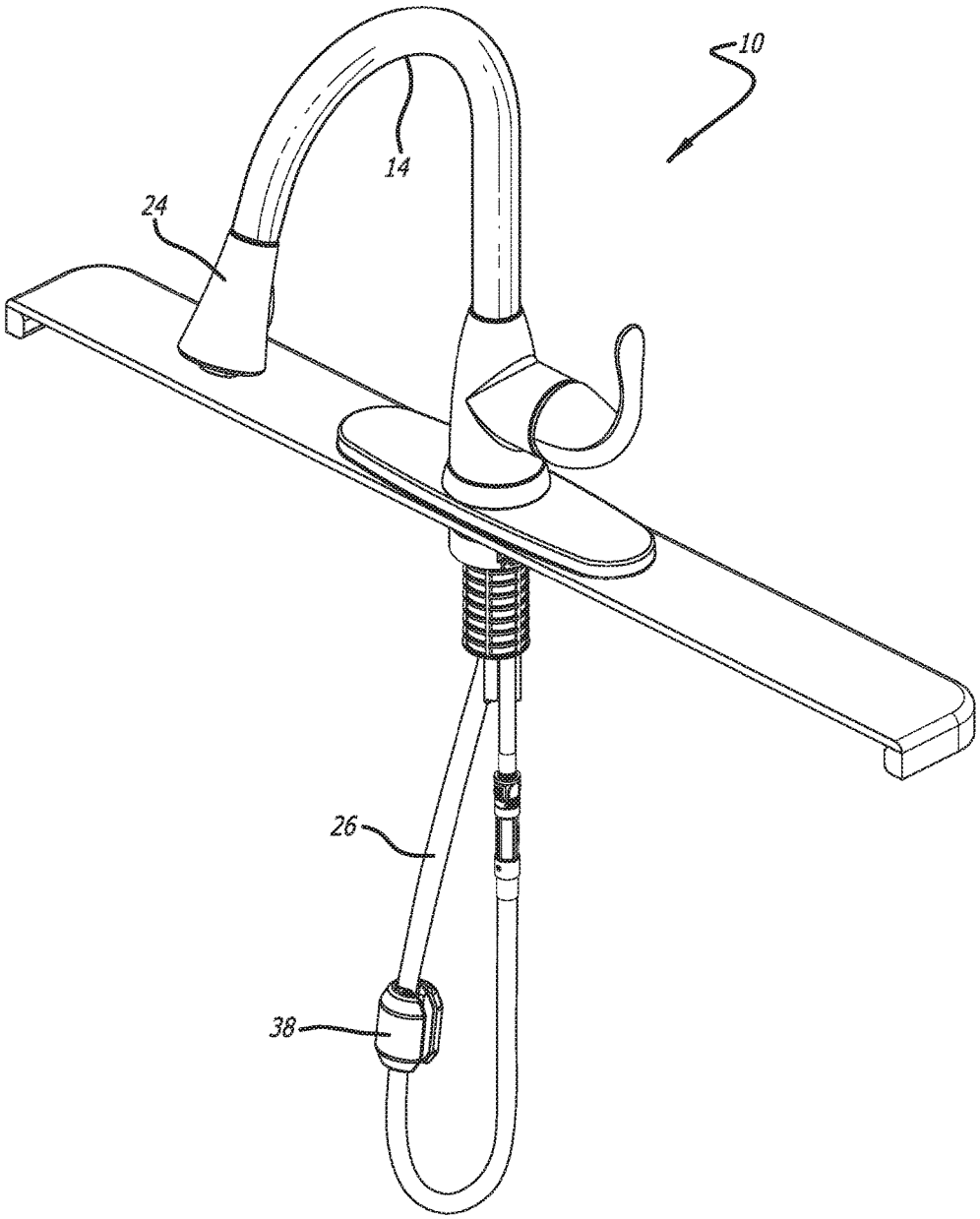
FIG. 3 is a perspective view of the above- and below-deck components of the pull-out faucet of FIG. 2 in their assembled configuration.

One embodiment of the invention is shown in FIGS. 1-16, including the complete faucet 10 shown in FIGS. 1-3. The faucet 10 includes a body 12 and a spout 14. The body 12 includes a base portion 16 and a handle 18 for regulating the amount of water that passes through the faucet 10. It will be understood, however, that a handle 18 is not necessarily required, and that motion detecting means and other means may be used for regulating the flow of water from the faucet 10.

In this embodiment, the spout 14 has a generally curved shape, and two distal ends. The inlet end 20 of the spout 14 is positioned near the base portion 16. Water from the water source enters the spout 14 near the inlet end 20 of the spout 14. The discharge end 22 of the spout 14 is positioned near the sprayhead 24. Water from the water source exits the spout 14 near the discharge end 22 of the spout 14.

Figure 5:
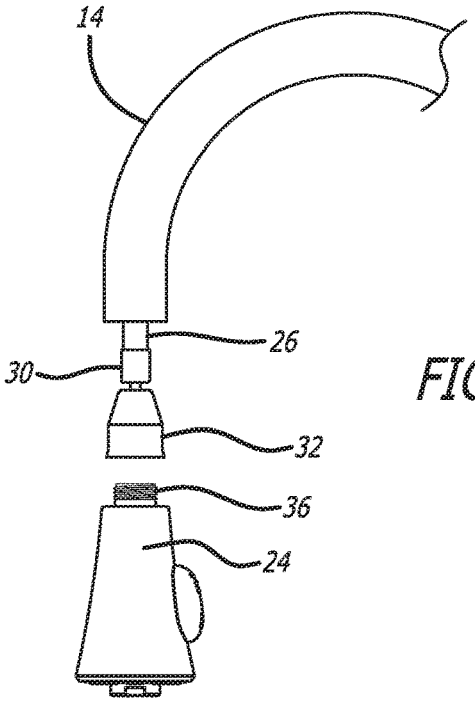
FIG. 5 is a perspective view of the spout portion of the faucet of FIG. 4, but further including the water hose and spray hose connector partially removed from the discharge end of the spout; and with the sprayhead separated from the water hose and spray hose connector.
Figure 6:
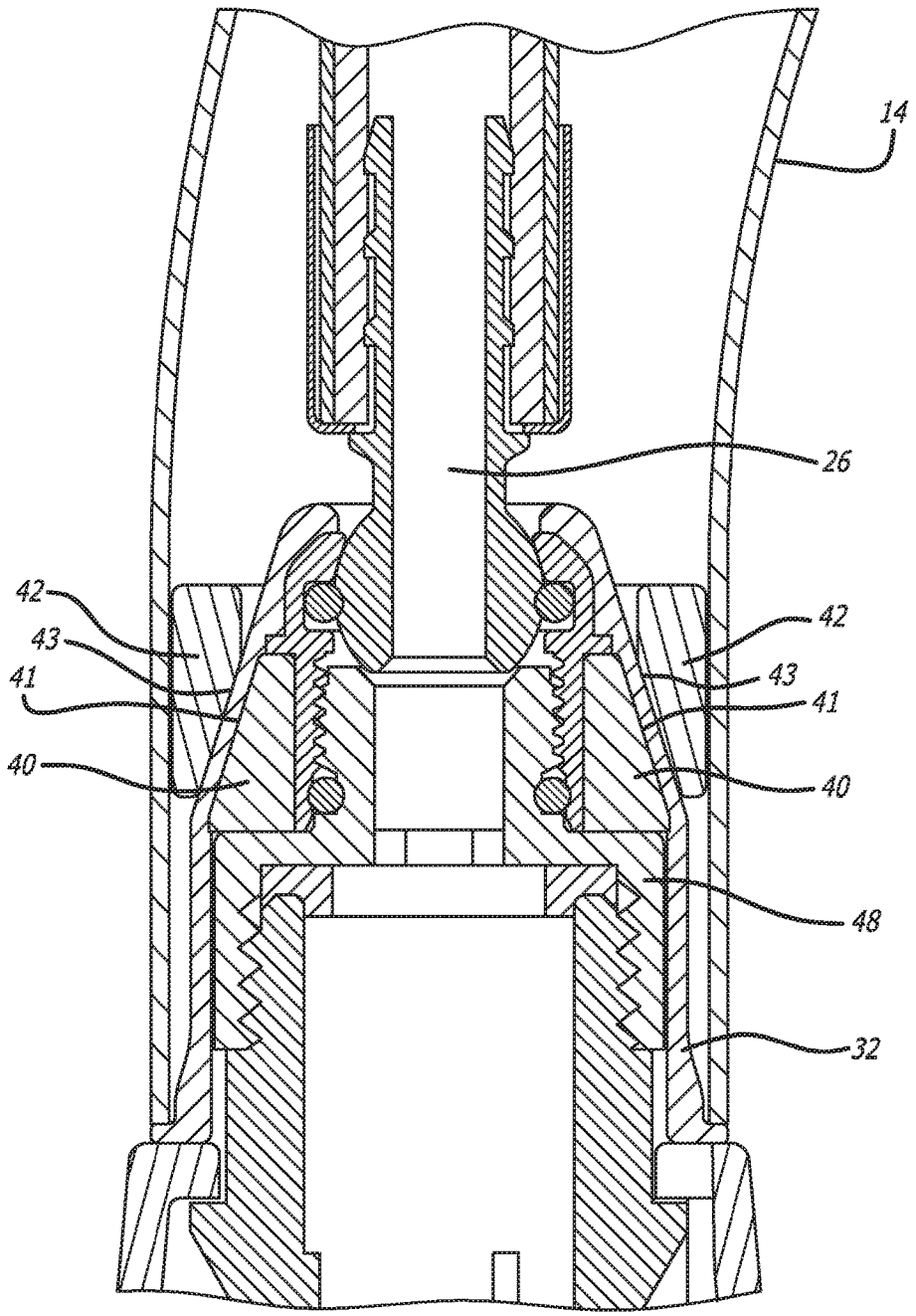
FIG. 6 is an enlarged, sectional view of the sprayhead, spray hose connector, and water hose of FIGS. 1 and 2, in the docked position.

The sprayhead 24 of the faucet 10 is shown in FIGS. 1-3 and 5. The sprayhead 24 is releasably secured to the spout 14. Specifically, the sprayhead 24 is releasably secured to the discharge end 22 of the spout 14. In FIGS. 1 and 3, the sprayhead 24 is shown in its docked position, i.e., in a position in contact with the discharge end of the spout 14. In FIGS. 2 and 5, the sprayhead 24 is shown in its undocked position, i.e., in a position apart from the discharge end 22 of the spout 14.

Referring now to FIGS. 2, 3, 5-8 and 16, the faucet 10 includes a water hose 26. The water hose 26 is contained within the faucet 10, and is movable within that faucet 10. Water from the water source enters the water hose 26 as its inlet end 28 and leaves the water hose at its discharge end 30. The movement of the water hose 26 within the faucet 10 and its spout 14 is necessary, as that movement facilitates the positioning of the sprayhead 24 between its docked and undocked configurations.

As may also be seen in FIGS. 2, 5, 8-9, and 16, the faucet 10 also includes a spray hose connector 32. In this embodiment, the spray hose connector 32 has a shape similar to that of a bell.

The spray hose connector 32 is attached to the discharge end 30 of the water hose 26. As may be seen in FIG. 9, the connection between the discharge end 30 of the water hose 26 and the spray hose connector 32 is effected by a ball joint 34. The ball joint 34 enables the spray hose connector 32 to swivel relative to the water hose 26. The spray hose connector 32 may be made of any suitable material. As will be explained later, the spray hose connector 32 may be made of a plastic (i.e., a polymer) that is formed by injection molding. A polymeric spray hose connector 32 that is made through injection over-molding can enable the capture of various components contained within that connector 32.

The spray hose connector 32 includes an inner connector 48 having internal threads. These internal threads of the inner connector 48 are complementary with the external threads 36 of sprayhead 24. The internal threads of the inner connector 48 engage the external threads 36 of the sprayhead 24 to connect the spray hose connector 32 to the sprayhead 24. When the spray hose connector 32 is threadably secured to the sprayhead 24, the water hose 26 and the spray hose connector 32 are in fluid communication with the sprayhead 24.

Again, sprayhead 24 is releasably attached to the water discharge end 22 of the spout 14. The sprayhead 24 is movable from a docked position (FIGS. 1 and 3), where it is secured to the discharge end 22 of the spout 14; to an undocked position (FIGS. 2 and 5), where it is moved away from that same discharge end 22 of the spout 14.

The sprayhead 24 is returned to, and retained in, its docked position by means of one or more components. Here, as may be seen in FIGS. 2 and 3, one component that may be used to return the sprayhead 24 to its docked position is a counterweight 38. The counterweight 38 is secured to the water hose 26.

Additional means for returning the sprayhead 24 to and retaining the sprayhead 24 in the docked position are magnetic attraction elements.

In this most preferred embodiment, the magnetic attraction elements comprise a magnet within the spray hose connector, and a metallic element within the spout. However, in practice these may be reversed, such that a magnet is secured to the spout, while the metallic element is secured to the interior of the spray hose connector. In addition, the magnetic attraction elements may be two magnets, one located within the spray hose connector and the other in the spout. The first magnet would have a first polarity and the second magnet would have a polarity opposite the first polarity.

Figure 11:
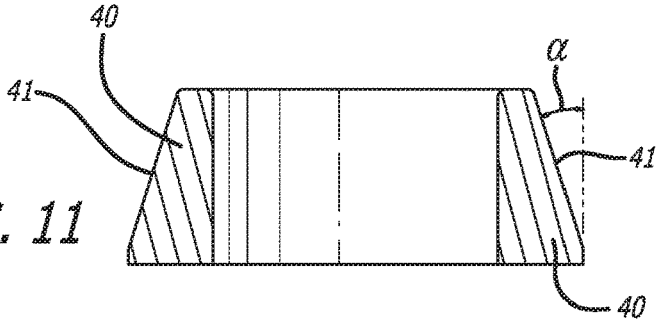
FIG. 11 is a front, sectional view of the magnet used in connection with the spray hose connector of FIG. 9.
Figure 12:
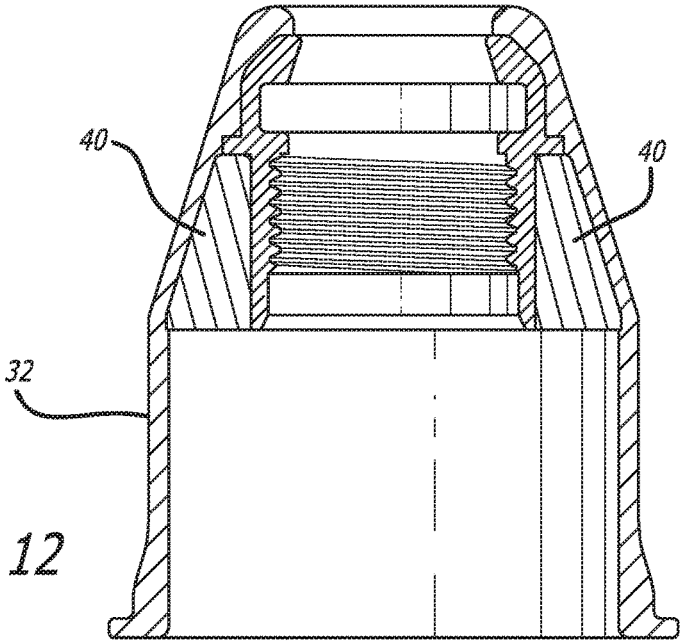
FIG. 12 is a sectional view of the spray hose connector assembled with the machined joint piece and the magnet.

The magnet 40 may be best seen in FIGS. 6, 8, 9, 11, and 12-16. The magnet 40 in isolation is shown in FIG. 11. As may be seen in this FIG. 11, the magnet 40 has a frusto-conical shape, i.e., having the shape of a cone with the narrow end or tip removed. The magnet 40 also has a hollow center, to allow the passage of fluid through it.

The preferred magnet 40 is a N50 magnet, i.e., a neodymium N50 magnet. The specification/measured field of this preferred magnet is 4600 Gs. However, any suitable magnet may be used.

This magnet 40 is secured to the interior of the spray hose connector 32. This may best be seen in FIGS. 6, 12, and 16. The hollow, frusto-conical shaped magnet 40 essentially circumscribes the interior of the spray hose connector 32.

The magnet 40 may be held in place within the spray hose connector 24 by any suitable means. Here, however, as may be seen in FIGS. 10-12, the magnet 40 is loaded onto a brass machined joint piece 44. Then, as may be seen in FIG. 12, the shell of the spray hose connector 32 is formed by injection molding around the joint piece 44 and magnet 40. In this way, the shell of the spray hose connector 32 captures and retains in place the joint piece 44 and magnet 40.

FIGS. 13-16 show additional assembly steps for the water hose 26, including its spray hose connector 32.

Figure 13:
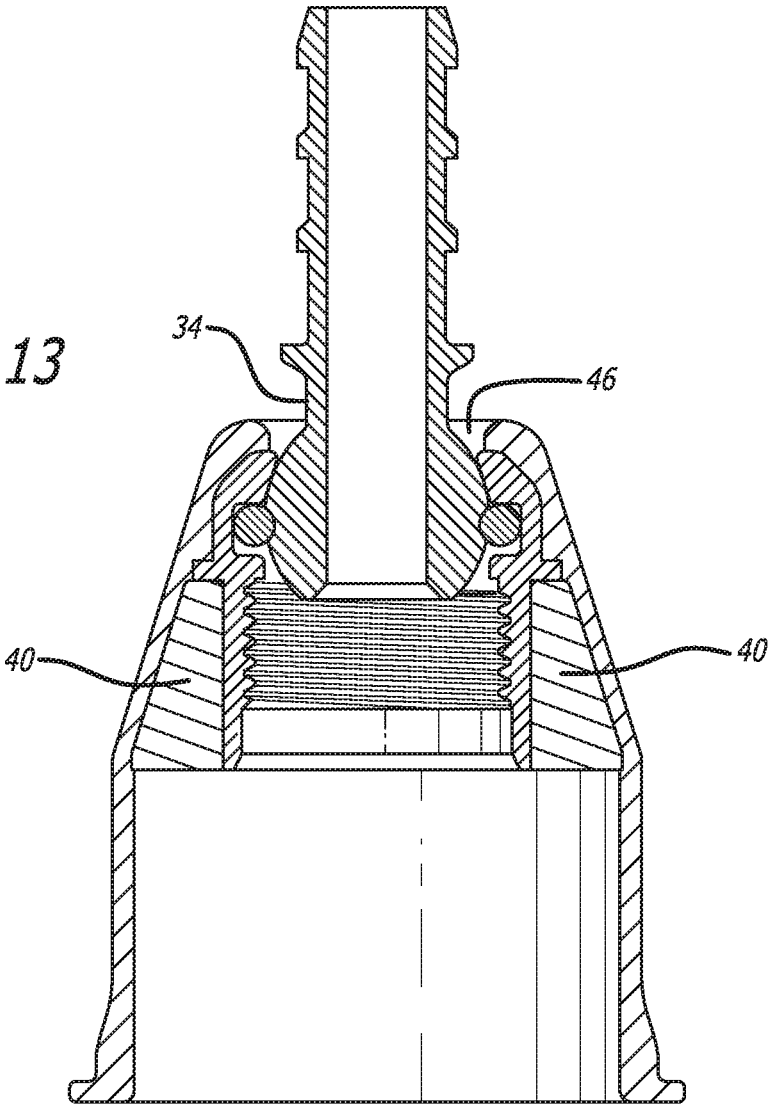
FIGS. 13-16 show additional steps in connection with the assembly of the spray hose.

FIG. 13 shows the installation of the ball joint 34 and an O-ring 46.

Figure 14:
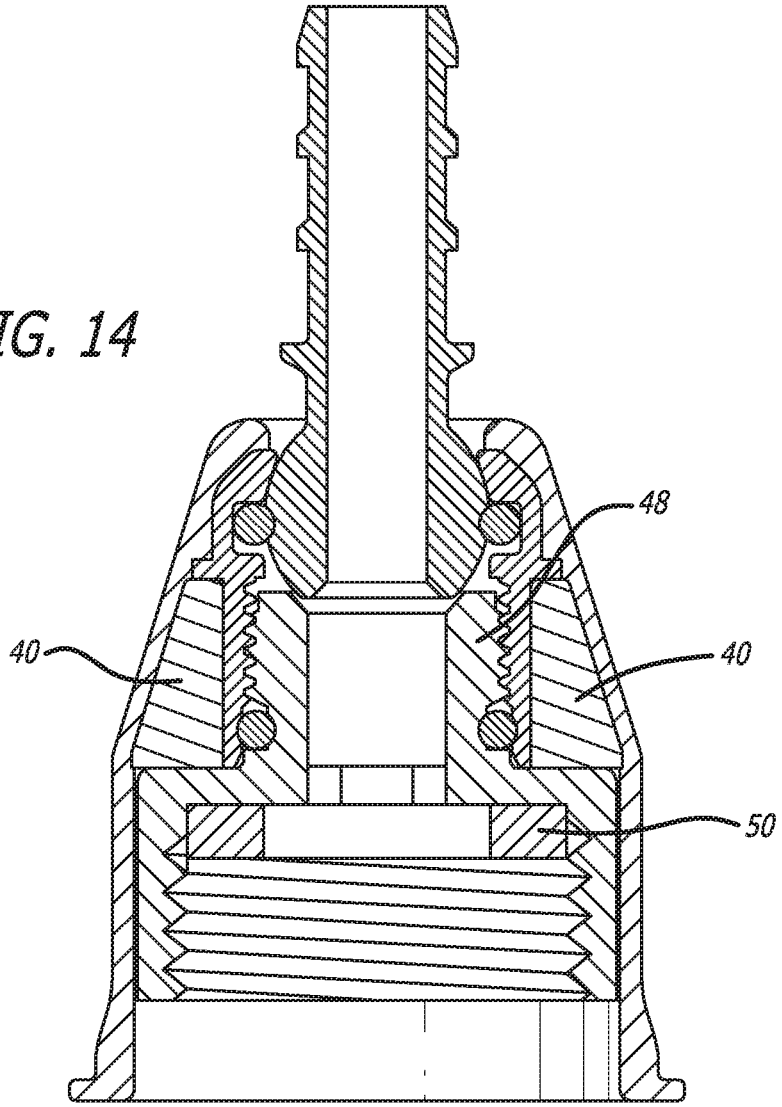

FIG. 14 shows the addition of the inner connector 48 and a gasket 50. The inner connector 48 is threaded into the machined joint piece 44 following the injection molding process. The purpose of the inner connector 48 is twofold: (i) to assist in holding and securing the magnet 40 in its position; and (ii) to act as a connecting element for the sprayhead 24, whose external threads 36 are secured to the internal threads of the inner connector 48.

The purpose of gasket 50 is to provide a fluid-tight seal between the hose connector 32 and the sprayhead 24.

Figure 15:
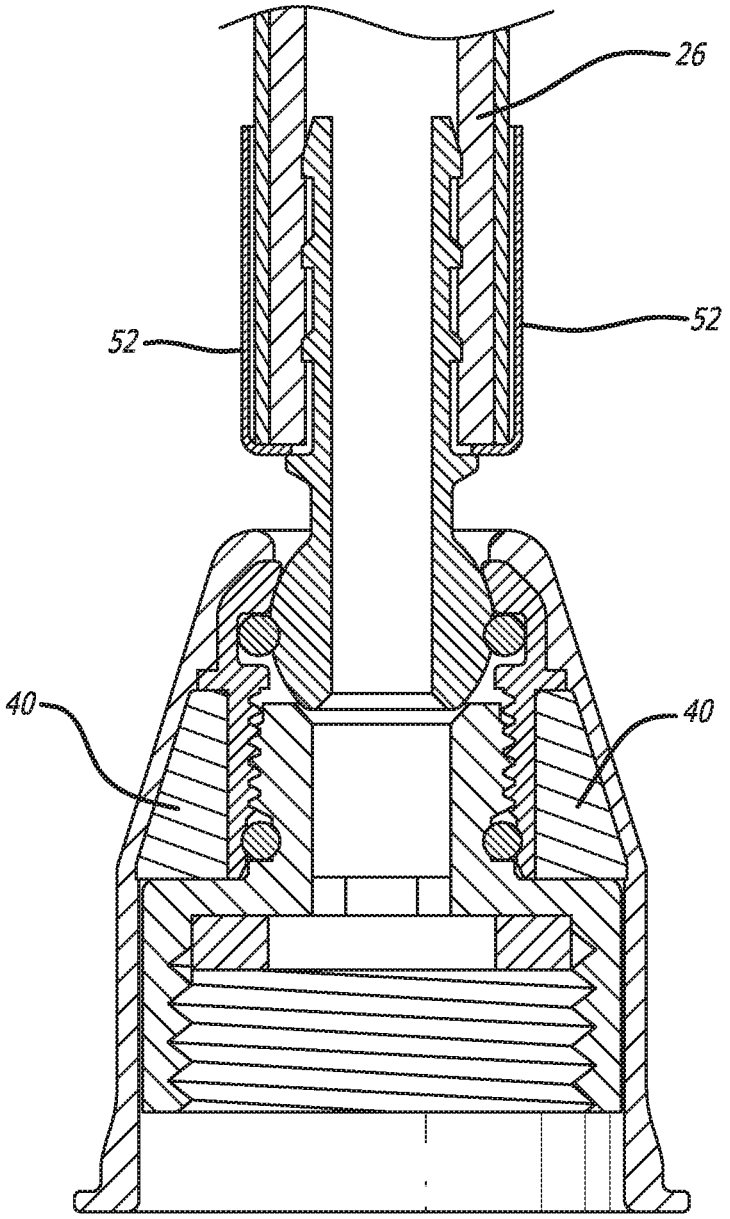

FIG. 15 shows the connection of the water hose 26 to a protective brass ring 52. The brass ring 52 is attached by riveting.

Figure 16:
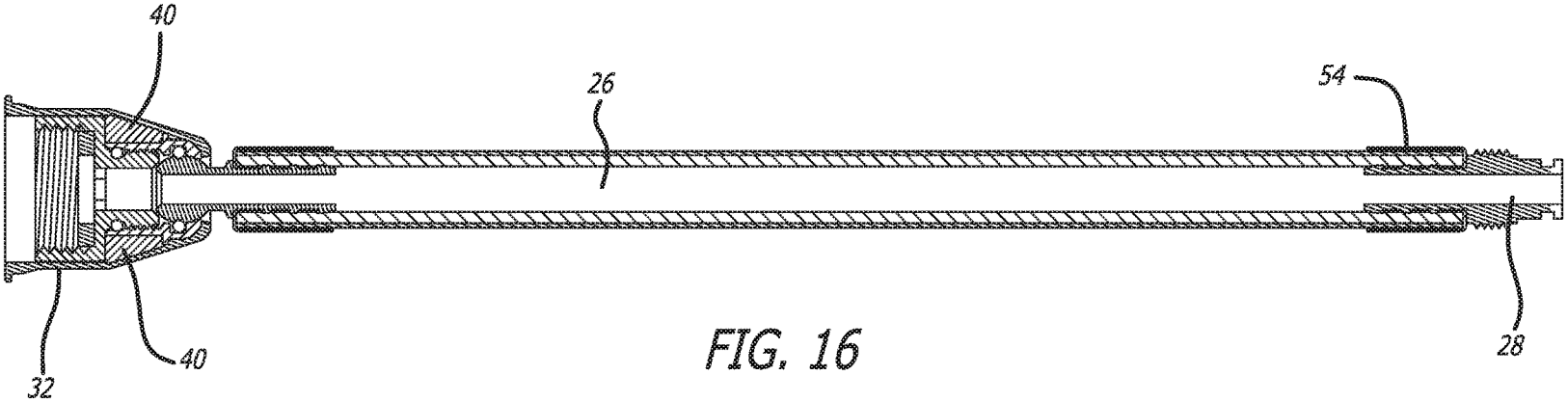

Finally, FIG. 16 shows the riveting of another connector 54 to the inlet end 28 of the water hose 26, to complete the process of forming this assembly.

As noted above, when the sprayhead 24 is in its docked position, it is positioned adjacent the discharge end 22 of the spout 14. As also noted above, positioned near the discharge end 22 of the spout 14 is a metallic element 42.

Figure 4:
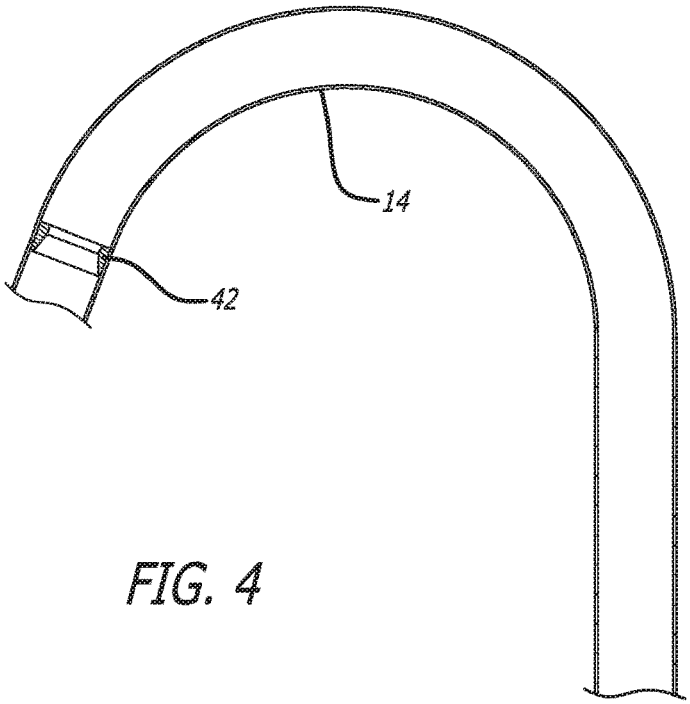
FIG. 4 is a perspective view of the spout portion of the faucet, but without the sprayhead.

As may best be seen in FIG. 4, this metallic element 42 is contained within the interior of the spout 14. The exterior of this metallic element 42 has a conventional ring shape. In this way, as may be seen in FIG. 6, the exterior or outer walls of this metallic element 42 can fit snugly against the complementary round inner walls of the spout 14.

The metallic element 42 is preferably hollow. As may be seen in FIG. 7, a portion of the inner walls 43 of the metallic element 42—that is, the lower portion of the inner wall 43 that forms or defines the hollow interior of the metallic element 42—create an inverted, hollow frusto-conical shape. By inverted, it is meant that the shape of the hollow portion at the lower end of the interior of the metallic element 42 is inverted, relative to the shape of the exterior of the frusto-conical magnet 40.

In this way, as installed, the shape of the inner walls 43 of the metallic element 42 complements the shape of the exterior walls 41 (FIGS. 7 and 11) of the magnet 40. As may be seen in FIG. 6, this complementary shape permits the exterior walls 41 of the magnet 40 and the inner walls 43 of the metallic element 42 to be in very close proximity to each other. In fact, as may also be seen in the docked position depicted in FIG. 6, the magnet 40 and metallic element 42 are separated from each other only be the thin outer wall of the spray connector 32.

Figure 9:
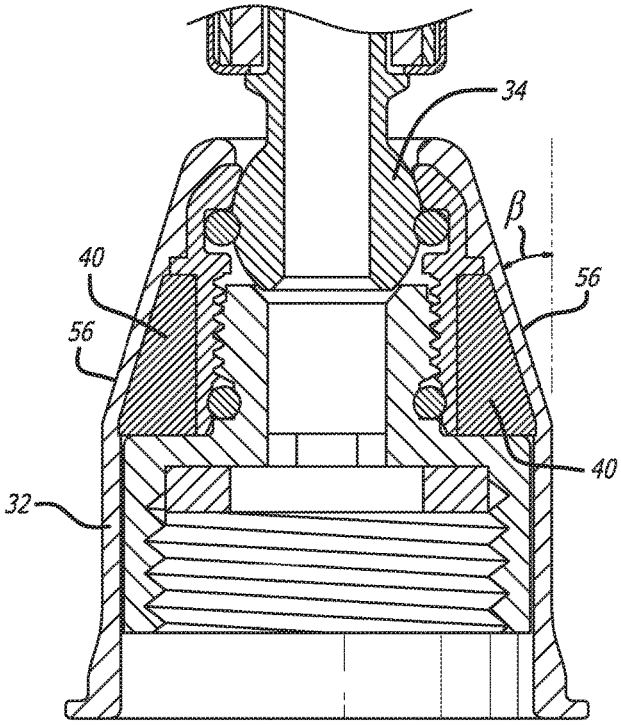
FIG. 9 is an enlarged, sectional view of the spray hose connector of FIG. 8.
Figure 10:
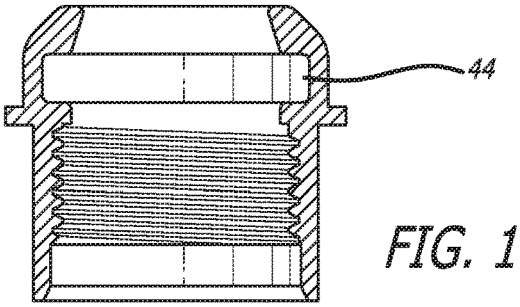
FIG. 10 is a frontal view of a machined joint piece used in connection with the spray hose connector of FIG. 9.

Referring again to FIG. 7 and especially FIG. 11, the exterior wall 41 of the magnet 40 has an angle $\alpha$ with the vertical of approximately 18°. Referring now to FIG. 9, the exterior wall 56 of the spray hose connector 32 has an angle $\beta$ with the vertical of approximately 18°. Finally, referring to FIG. 7, inner walls 43 of the metallic element 42 have an angle $\gamma$ with the vertical of approximately 18°. As a result of these angles and the thinness of the walls of the spray hose connector 32, there exists a closely adjacent relationship between the magnet 40 and the metallic element 42. This closely adjacent position of the magnet 40 and the metallic element 42 increases the magnetic forces between them, and results in a powerful magnetic attraction between them, as for example when the magnet 40 is approaching the metallic element 42 during the docking procedure. The three walls having the substantially identical angles $\alpha$, $\beta$, and $\gamma$ as defined above are said have "complementary angles."

While the embodiment shown in the Figures and described in this specification includes complementary angles of about 18°, the invention is contemplated to include any suitable complementary angles. These complementary angles could range from 2° from the vertical to 50° from the vertical, with a preferred range of 2° to 25° from the vertical, and most preferred range of 15° to 21° from the vertical, as vertical is defined and depicted for each of the three angles described above.

While the magnet 40 and the metallic element 42 of the above preferred embodiment have the shapes and structures described above, it should be understood that the magnet 40 and the metallic element 42 could also both be of a conventional ring or frusto-conical shape; or that one of these two could be a ring, and the other one of these two could be frusto-conical.

The metallic element 42 can be made of any material that is magnetically attractive. In this preferred embodiment, however, the metallic element 42 is made of stainless steel, such as SUS 430 stainless steel. The metallic element 42 may be welded onto the interior walls of the spout 14.

As mentioned previously, it should also be understood that the magnetic attraction elements 40, 42 may also be two magnets, with one magnet having a first polarity and the second magnet having a polarity opposite the first.

The spout 14 may also be made of any suitable material. Non-limiting examples of a suitable material for the spout 14 are stainless steel or brass, although other materials could be used as well. In this preferred embodiment, the spout 14 is made of a SUS 201 stainless steel.

Figure 7:
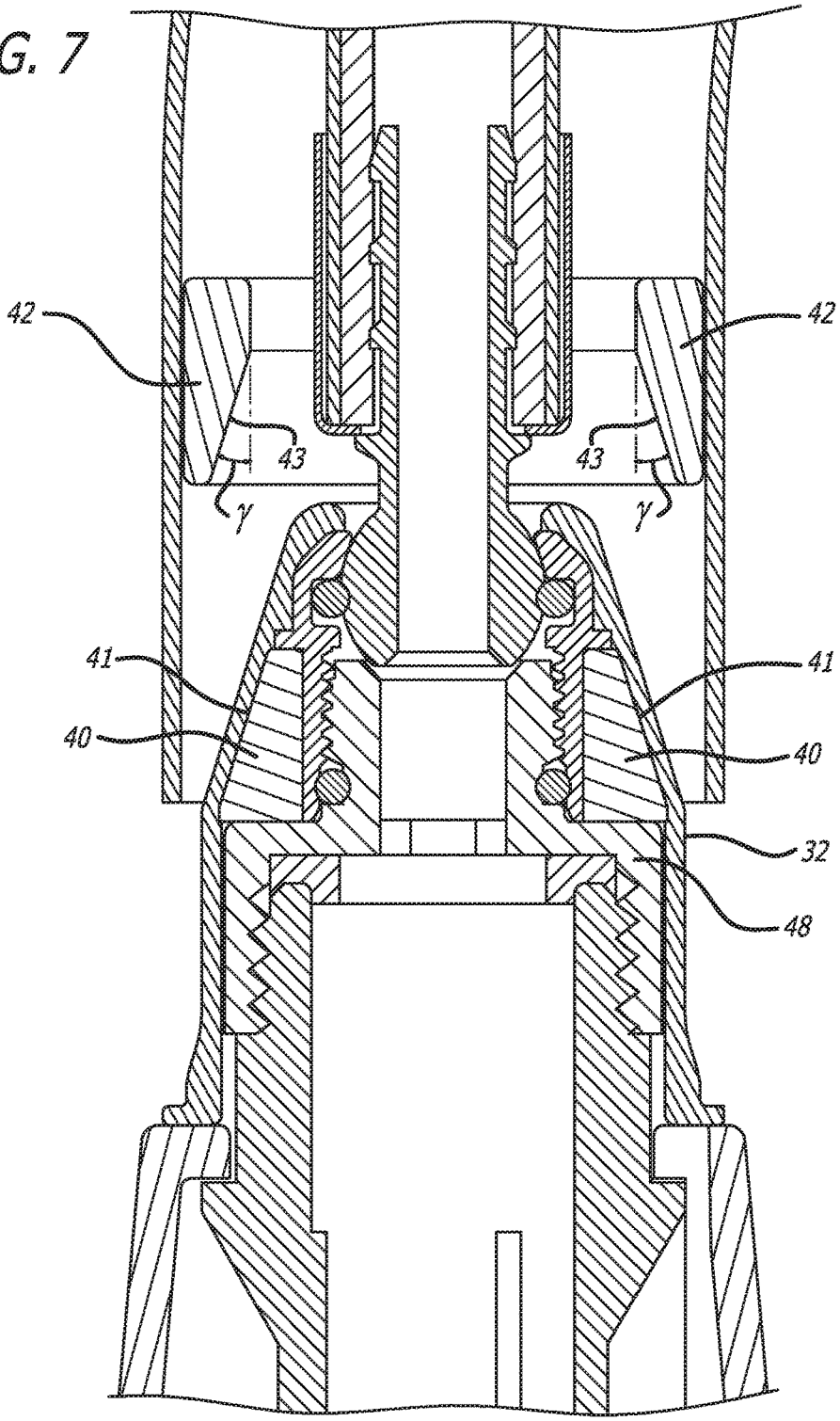
FIG. 7 is an enlarged, sectional view of the sprayhead, spray hose connector, and water hose of FIGS. 1 and 2, in their undocked position.
Figure 8:
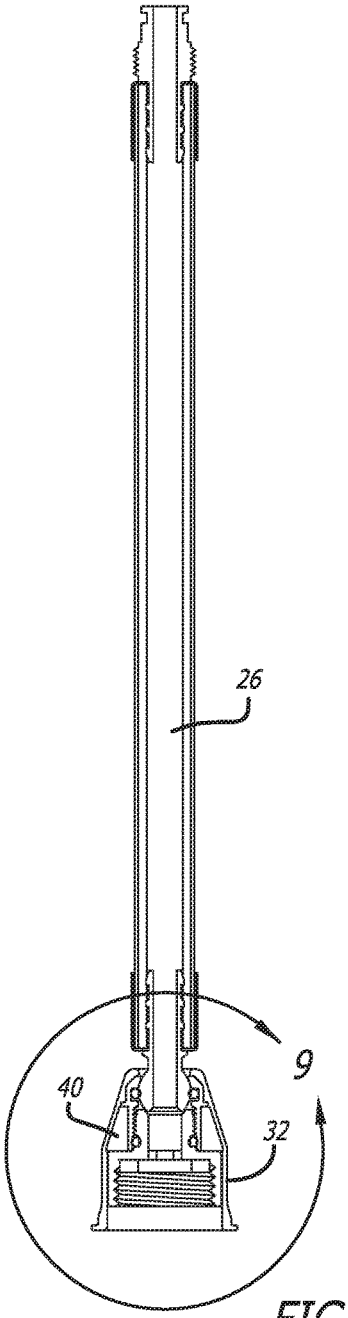
FIG. 8 is a perspective, partially sectional view of the spray hose connector and spray hose of FIG. 7.

The sprayhead 24 is shown in its undocked position in FIGS. 2, 5, and 7. It is shown in its docked position in FIG. 6. The combination of the magnet 40 in the spray hose connector 32 with the metallic element 42 secured within the spout 14 results in a secure connection between the sprayhead 24 and the spout 14. In addition, when the undocked sprayhead 24 approaches the discharge end 22 of the spout 14, the magnetic force of the magnet 40 draws the sprayhead 24 towards spout 14 in a swift and powerful manner.

What is claimed is:

1. A pull-down faucet, comprising:

(a) a spout having an inlet end and a discharge end;

(b) a water hose with an inlet end and a discharge end, the water hose extending into the spout and movable relative to the spout;

(c) a spray hose connector attached to the discharge end of the water hose and releasably secured to the discharge end of the spout;

(d) a sprayhead in fluid communication with the water hose and attached to the spray hose connector, the spray hose connector and the sprayhead movable between a docked position where the spray hose connector and the sprayhead are removably secured to the discharge end of the spout, and an undocked position where the spray hose connector and the sprayhead are spaced apart from the discharge end of the spout;

(e) a magnet secured within the spray hose connector; and (f) a metallic element secured to the spout and adjacent the discharge end of the spout, the metallic element having a central opening that engages an extent of the spray hose connector in the docked position;

wherein the magnet is configured to provide a magnetic attraction force with the metallic element for biasing the sprayhead toward the docked position, and wherein in the docked position, said engagement between the spray hose connector and the central opening prevents the magnet from passing through the central opening of the metallic element.

2. The faucet of claim 1, wherein the magnet is of a hollow, frusto-conical shape.

3. The faucet of claim 1, wherein the magnet moves upwardly with the spray hose connector from the undocked position to the docked position.

4. The faucet of claim 1, wherein the magnet circumscribes an interior of the spray hose connector.

5. The faucet of claim 1, wherein the metallic element is fixed to the inside of the spout.

6. The faucet of claim 1, further comprising a ball joint that effects the connection between the water hose and the spray hose connector, wherein, in the docked position, an extent of the ball joint extends beyond the metallic element and into the spout.

7. A pull-down faucet, comprising:

(a) a spout having an inlet end and a discharge end;

(b) a water hose with an inlet end and a discharge end, the water hose extending into the spout and movable relative to the spout;

(c) a spray hose connector attached to the discharge end of the water hose and releasably secured to the discharge end of the spout;

(d) a sprayhead in fluid communication with the water hose and attached to the spray hose connector, the spray hose connector and the sprayhead movable between a docked position where the spray hose connector and the sprayhead are removably secured to the discharge end of the spout, and an undocked position where the spray hose connector and the sprayhead are spaced apart from the discharge end of the spout;

(e) a first magnetic attraction element secured within the spray hose connector; and (f) a second magnetic attraction element secured to the spout adjacent the discharge end of the spout, the second magnetic attraction element having a central opening that engages an extent of the spray hose connector in the docked position;

wherein the magnetic attraction elements are configured to provide a magnetic attraction force there between for biasing the sprayhead toward the docked position, wherein in the docked position, said engagement between the second magnetic attraction element and the spray hose connector prevents the first magnetic attraction element from passing through the central opening of the second magnetic attraction element.

8. The faucet of claim 7, wherein the first magnetic attraction element is a magnet, and the second magnetic attraction element is a metallic element.

9. The faucet of claim 7, wherein the first magnetic attraction element is a metallic element, and the second magnetic attraction element is a magnet.

10. The faucet of claim 7, wherein the first magnetic attraction element is a first magnet having a first polarity, and the second magnetic attraction element is a second magnet having a second polarity that is the opposite of the first polarity.

11. The faucet of claim 8, wherein the magnet has an exterior wall, the spray hose connector has an exterior wall, and the metallic element has an inner wall; and wherein each of the exterior wall of the magnet, the exterior wall of the spray hose connector, and the inner wall of the metallic element have a substantially common complementary angle.

12. The faucet of claim 11, wherein the complementary angle ranges from 2° to 50°.

13. The faucet of claim 11, wherein the complementary angle ranges from 2° to 25°.

14. The faucet of claim 11, wherein the complementary angle ranges from 15° to 21°.

15. The faucet of claim 11, wherein the complementary angle is approximately 18°.

16. The faucet of claim 1, further comprising a ball joint that connects the water hose to the spray hose connector;

wherein the spray hose connector includes a joint piece that engages with the ball joint, and wherein the magnet is positioned between the joint piece and an external wall of the spray hose connector.

17. The faucet of claim 16, wherein the spray hose connector is injection molded over the joint piece and the magnet.

18. The faucet of claim 16, wherein the external wall of the spray hose connector radially surrounds the magnet and an upper portion of the spray hose connector is positioned between the magnet and the metallic element when the sprayhead is in the docked position.

19. The faucet of claim 1, wherein the spray hose connector has an angled exterior wall and the metallic element has an angled inner wall; and wherein each of the exterior wall of the spray hose connector and the inner wall of the metallic element have a substantially common complementary angle that facilitates sliding engagement between the metallic element and the spray hose connector as the spray hose connector moves to the docked position.

* * * * *